US005513908A

United States Patent [19]

Williams

[11] Patent Number: 5,513,908

[45] Date of Patent: May 7, 1996

[54] MODULAR SYSTEM FOR ASSEMBLING FOOD SERVICE FIXTURES

[75] Inventor: Ralph E. Williams, Littleton, Colo.

[73] Assignee: Kloppenberg & Company, Englewood, Colo.

[21] Appl. No.: 252,745

[22] Filed: Jun. 2, 1994

[51] Int. Cl.[6] ..... A47B 57/00; A47F 5/08

[52] U.S. Cl. ..... 312/140.1; 108/64; 108/48; 211/181; 211/90; 312/111; 312/245; 312/128

[58] Field of Search ..... 312/107.5, 109, 312/111, 114, 117, 128, 140, 140.1, 245, 140.3, 116, 108; 211/90, 150, 181, 153, 1183; 403/235, 237, 406.1; 108/43, 47, 48, 64, 110, 163, 180–188, 151, 161; 217/150, 140, 153, 181, 186; 248/250, 247, 235, 4

[56] References Cited

U.S. PATENT DOCUMENTS

| | | | |
|---|---|---|---|
| 2,404,182 | 7/1946 | Kump | 312/107 |
| 3,170,742 | 2/1965 | Berkowitz | 108/64 |
| 3,208,406 | 9/1965 | Maslow | 108/64 |
| 3,225,720 | 12/1965 | Maslow | 108/64 |
| 3,490,393 | 1/1970 | Nelson | 108/110 X |
| 3,763,794 | 10/1973 | Fleck | 108/64 |
| 4,231,298 | 11/1980 | Pollack | 108/64 |
| 4,666,201 | 5/1987 | Chap | 108/64 X |
| 4,696,407 | 9/1987 | Franklin | 211/183 |
| 5,027,959 | 7/1991 | Luukkonen | 211/181 X |
| 5,050,832 | 9/1991 | Lee et al. | 312/245 X |

FOREIGN PATENT DOCUMENTS

| | | |
|---|---|---|
| 2042513 | 5/1991 | Canada . |

*Primary Examiner*—Peter M. Cuomo
*Assistant Examiner*—Robert J. Sandy
*Attorney, Agent, or Firm*—Dorr, Carson, Sloan & Birney

[57] ABSTRACT

A modular system for assembling food service fixtures employs a plurality of leg assemblies each having a front leg, a rear member that can be selectively suspended at desired locations from a horizontal rail, and a substantially horizontal member extending between the rear member and front leg. Clips are used to removably secure shelves between the horizontal members of adjacent leg assemblies. A counter top extends from the back plane and is supported by the upper ends of the front legs. Each front leg includes a standardized set of fastening means for interchangeably fastening any of a plurality of alternative front members (doors, aprons, plate shelves, panels, etc.) between adjacent leg assemblies. In the preferred embodiment, the shelves are made of a plurality of wire rods. Upper and lower wire rods extend along the lateral edges of each shelf. Each clip has a slot for receiving the horizontal member of one of the leg assemblies, at least one J-shaped member for receiving and supporting the lower wire rod, and a tab for retaining the upper wire rod when the shelf is engaged to the clip.

15 Claims, 9 Drawing Sheets

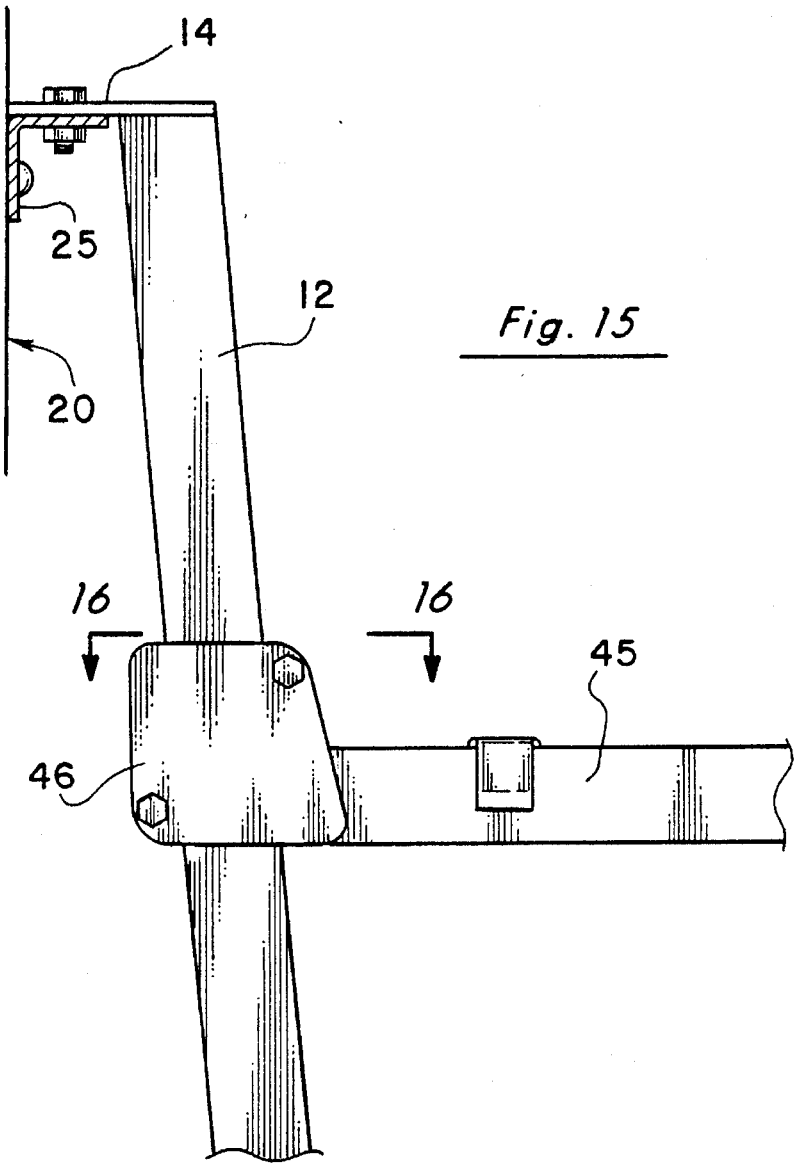
Fig. 15
Fig. 16
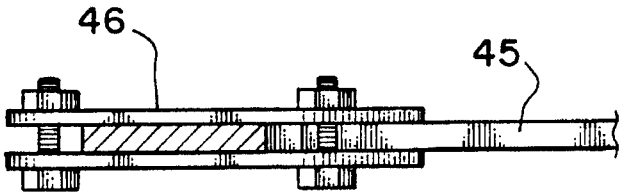

MODULAR SYSTEM FOR ASSEMBLING FOOD SERVICE FIXTURES

BACKGROUND OF THE INVENTION

1. Field of the Invention.

The present invention relates generally to the field of food service fixtures, such as counter tops, shelving, sinks, and the like. More specifically, the present invention discloses a modular system for assembling food service fixtures using standardized components.

2. Statement of the Problem.

Food service fixtures (e.g., counter tops, shelves, sinks, drawers, and related fixtures with openings to accommodate appliances) are widely used by restaurants, cafeterias, hospitals, and other institutions involved in preparation of food. These fixtures are commonly made with a continuous counter top that covers a variety of different sections for shelving, drawers, plate shelves, aprons, doors, panels, appliances, and the like beneath the counter top. In addition, the counter top itself must accommodate sinks, cooking appliances, disposal openings, and the like that extend downward through the counter top. For example, work-flow patterns and existing walls, plumbing, and ventilation ductwork often impose significant constraints on the possible arrangement and location of fixture components. As a result of the unique needs and constraints associated with each installation, fixtures have traditionally been designed and manufactured on a custom basis. This significantly increases the costs of designing and manufacturing food service fixtures. Custom design also increases the lead time necessary to finish a job and increases the chance of error in manufacture or assembly.

Modular shelving systems and other types of modular furniture have used in the past in a wide variety of other fields, including the following:

| Inventor | Patent No. | Issue Date |
|---|---|---|
| Kump | 2,404,182 | July 16, 1946 |
| Maslow | 3,208,406 | Sep. 28, 1965 |
| Maslow | 3,225,720 | Dec. 28, 1965 |
| Pollack | 4,231,298 | Nov. 4, 1980 |
| Chap | 4,666,201 | May 19, 1987 |
| Franklin | 4,696,407 | Sep. 29, 1987 |
| Irja | Canada 2,042,513 | Feb. 21, 1992 |

Kump discloses furniture having legs that can be readily detached from the main body of the piece to allow the main body to be used independently or stacked. Cabinets can be secured together using clips 51 as shown in FIG. 1*a* of the Kump patent.

U.S. Pat. No. 3,208,406 to Maslow shows a coupling clip 50 for assembling knockdown shelving units. U.S. Pat. No. 3,225,720 to Maslow shows a corner brace for use in construction of shelving assemblies.

Pollack discloses a shelving system for swift assembly and disassembly. The system uses a number of ladder-type uprights with vertically spaced cross braces extending between vertical posts. Each vertical post has inner and outer post elements that allow insertion of a shelf without the necessity of its being tilted or cocked. Each shelf has right-angular, inwardly extending locking tongues or tabs 40 at its corners. These locking tongues are initially located during assembly in wide spaces defined between the inner and outer post elements. The shelf is then moved downward along the uprights from the wide spaces into narrower spaces in which the corners of the shelf lock.

Chap discloses a modular wire rack for storing various types of wrapping materials. Two rack modules can be placed back to back and fastened together by means of friction clips 60.

Franklin discloses a display unit for displaying small merchandise in a series of bays along a wall or partition. The bays are formed by dividers constructed of pairs of angularly arranged vertical panels that are hingedly connected to one another and are also secured to the wall at spaced intervals. A principal header extends along the upper periphery of the rear wall to cover up mismatches between the rear wall sections and to support placards.

Irja discloses a set of shelves that includes a number of vertical elements and horizontal shelves that can be assembled in a variety configurations using a clip or "fixing element" 6 shown in FIGS. 4–6 of this patent.

SOLUTION TO THE PROBLEM

None of the prior art references uncovered in the Applicant's search show a modular system for assembling food service fixtures having the structure of the present invention. In particular, the present system uses a series of leg assemblies that can be suspended at desired intervals from a rear rail. Shelves are removably secured between adjacent leg assemblies by means of clips to provide dimensional accuracy. A variety of front members can be interchangeably attached between the front legs of adjacent leg assemblies. This modular system can be easily customized in a wide variety of configurations to accommodate the customer's needs.

SUMMARY OF THE INVENTION

This invention provides a modular system for assembling food service fixtures. A plurality of leg assemblies having a front leg and a rear member can be selectively suspended at desired locations from a horizontal rail running along a back plane. A substantially horizontal member extends between the rear member and front leg of each leg assembly. Clips are used to removably secure shelves between the horizontal members of adjacent leg assemblies. A counter top extends from the back plane and is supported by the upper ends of the front legs. Each front leg includes a standardized set of fastening means for interchangeably fastening any of a plurality of alternative front members (doors, aprons, plate shelves, panels, etc.) between adjacent leg assemblies. In the preferred embodiment, the shelves are made of a plurality of wire rods. Upper and lower wire rods extend along the lateral edges of each shelf. Each clip has a substantially vertical slot for receiving the horizontal member of one of the leg assemblies, at least one J-shaped member for receiving and supporting the lower wire rod of a shelf, and a tab for retaining the upper wire rod when the shelf is engaged to the clip.

A primary object of the present invention is to provide a modular system for assembling food service fixtures in which the arrangement and dimensions of desired sections can be readily customized using standardized components. This results in substantial cost savings and reduced lead time for orders.

Another object of the present invention is to provide modular food service fixtures that can be more easily and quickly assembled on site.

Yet another object of the present invention is to provide food service fixtures that can be easily disassembled for cleaning and that can be easily reassembled in other configurations to meet changing customer needs.

These and other advantages, features, and objects of the present invention will be more readily understood in view of the following detailed description and the drawings.

BRIEF DESCRIPTION OF THE DRAWINGS

The present invention can be more readily understood in conjunction, the accompanying drawings, in which:

FIG. 15 is detail side view of the upper portion of the rear member of a leg assembly showing the bracket used to support a second shelf.

FIG. 16 is cross-sectional view corresponding to FIG. 15 showing the shelf support bracket and the rear member of the leg assembly.

DETAILED DESCRIPTION OF THE INVENTION

Figure 1A:
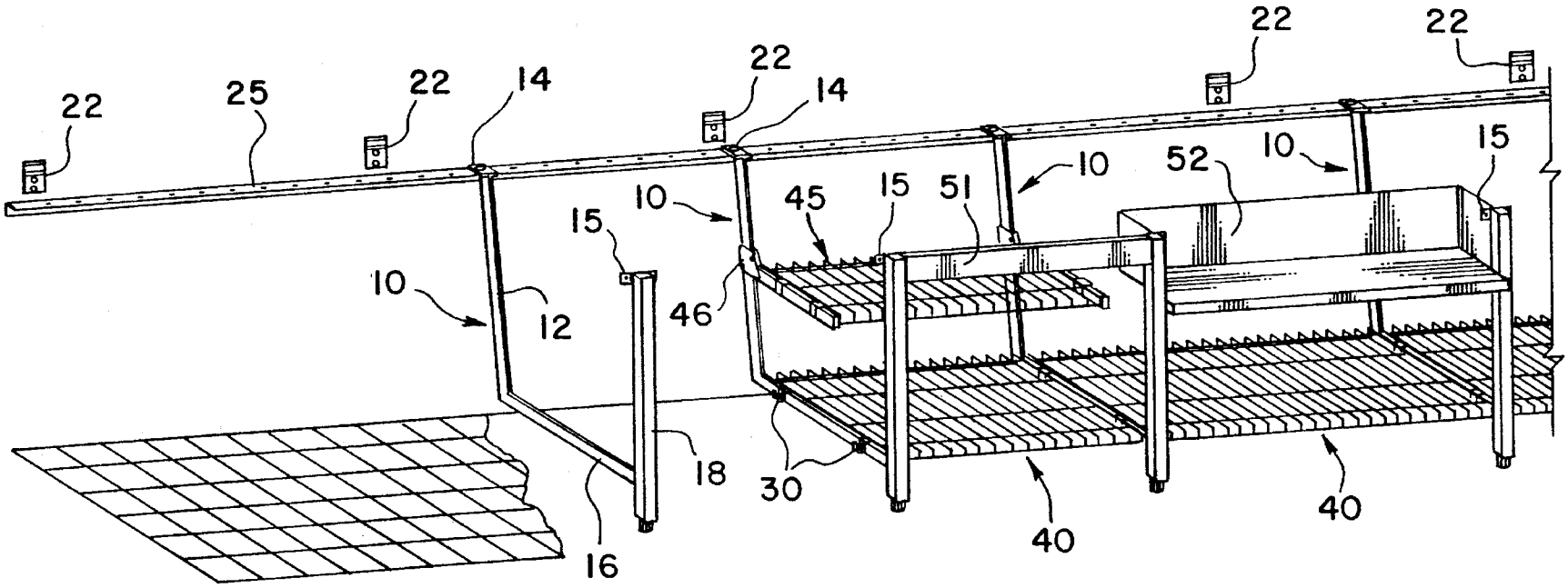
FIG. 1*a* is a front perspective view of a portion of a partially assembled food service fixture in accordance with the present invention.
Figure 1B:
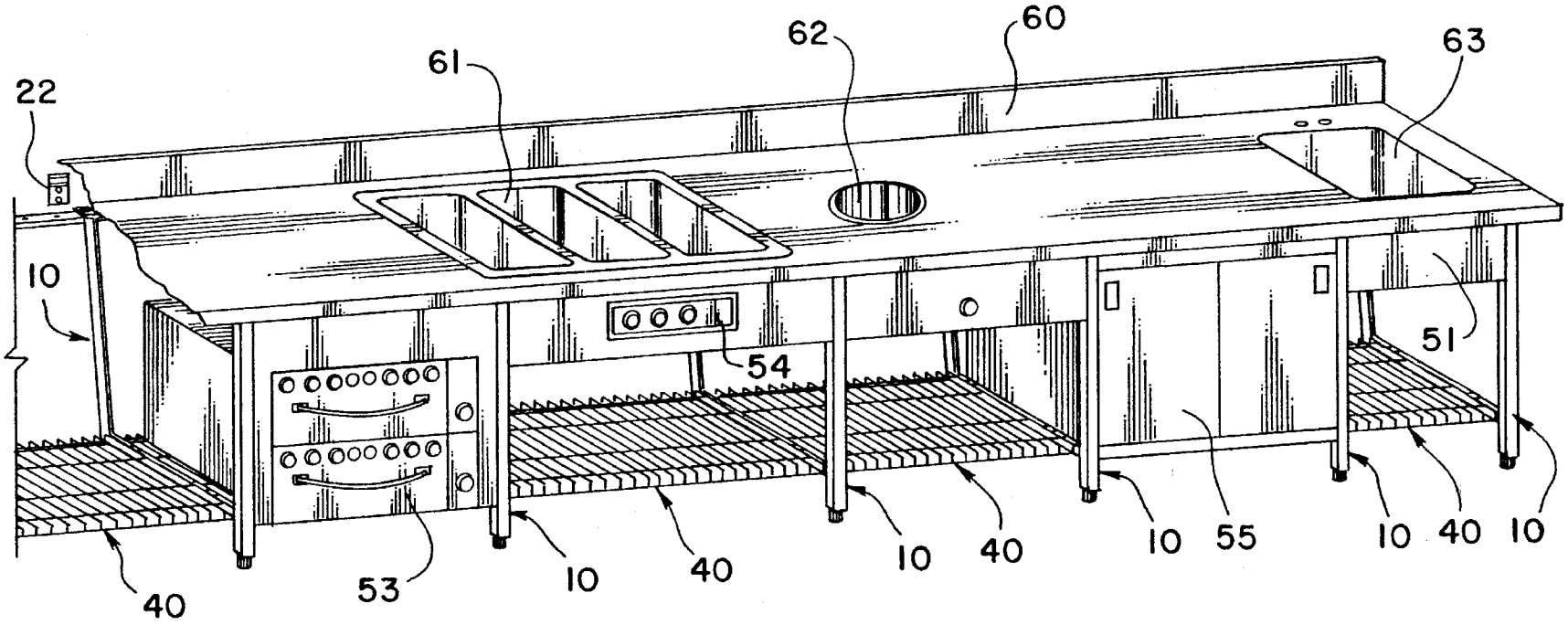
FIG. 1*b* is a front perspective view of another portion of an assembled food service fixture.
Figure 2:
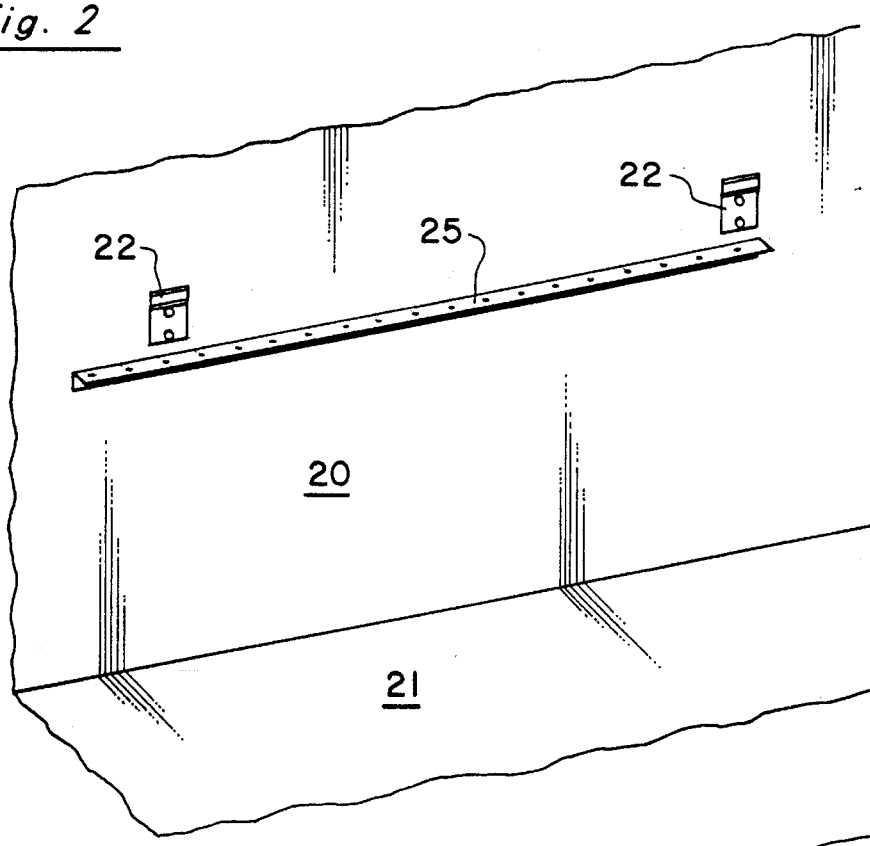
FIG. 2 is a front perspective view of the rail and counter top brackets attached to a wall prior to installation of the food service fixture.
Figure 3:
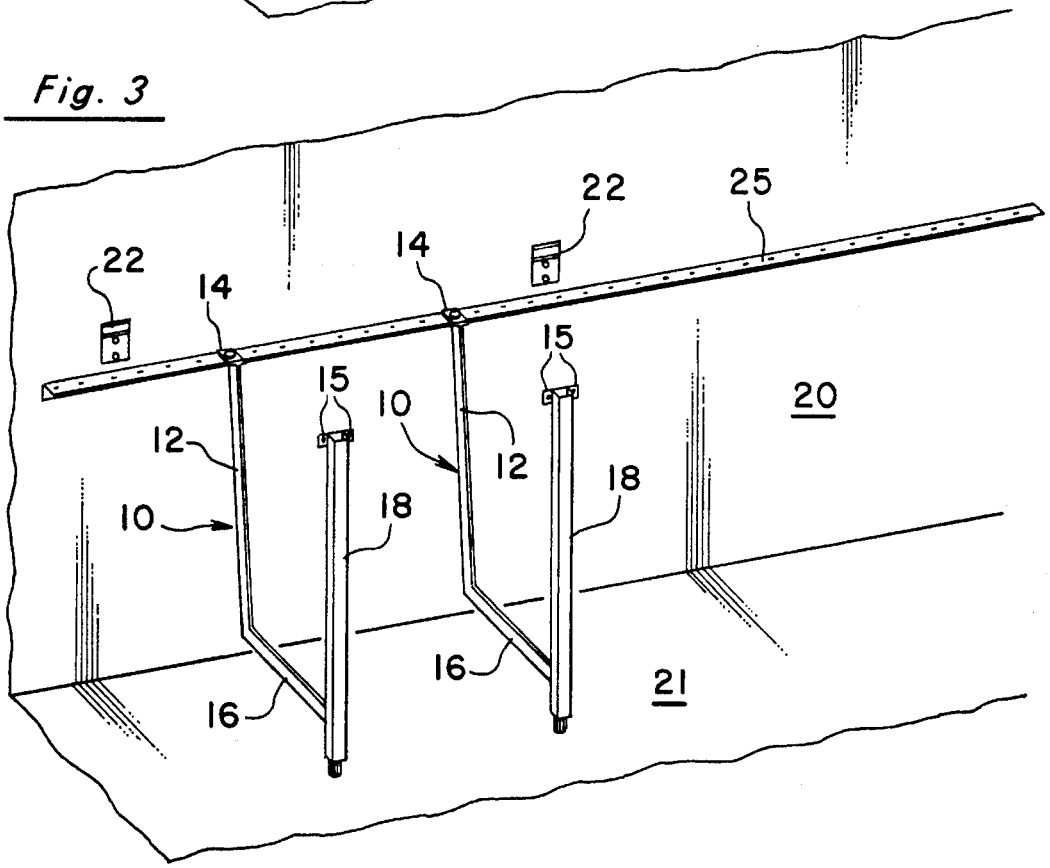
FIG. 3 is a front perspective view corresponding to FIG. 2 after two leg assemblies have been attached.

Turning to FIGS. 1*a* and 1*b*, a general overview of the present modular system is illustrated. FIGS. 2 through 5 depict the steps in assembling a typical food service fixture. A horizontal rail 25 is mounted to the wall 20 or other suitable back plane for the fixture (see FIG. 2). A series of counter top brackets 22 are also mounted to the wall at intervals. A number of leg assemblies 10 are suspended from the rail 25 at desired locations along the length of the rail (see FIG. 3). Each leg assembly includes a rear member 12, a front leg 18, and a horizontal member 16 extending between the rear member 12 and the front leg 18 as shown in FIGS. 1*a* and 3. The upper end of the rear member 12 also has a bracket 14 or other equivalent means 14 for attaching the rear member 12 to the rail 25. The front leg 18 is supported on its lower end by the floor 21 and extends upward in a substantially vertical direction. The upper end of each front leg 18 bears a standardized set of brackets 15, holes 19, or other fastening means used to secure the counter top 60 and any of a variety of interchangeable front panels to the leg assembly 10, as will be described in greater detail below.

Figure 4:
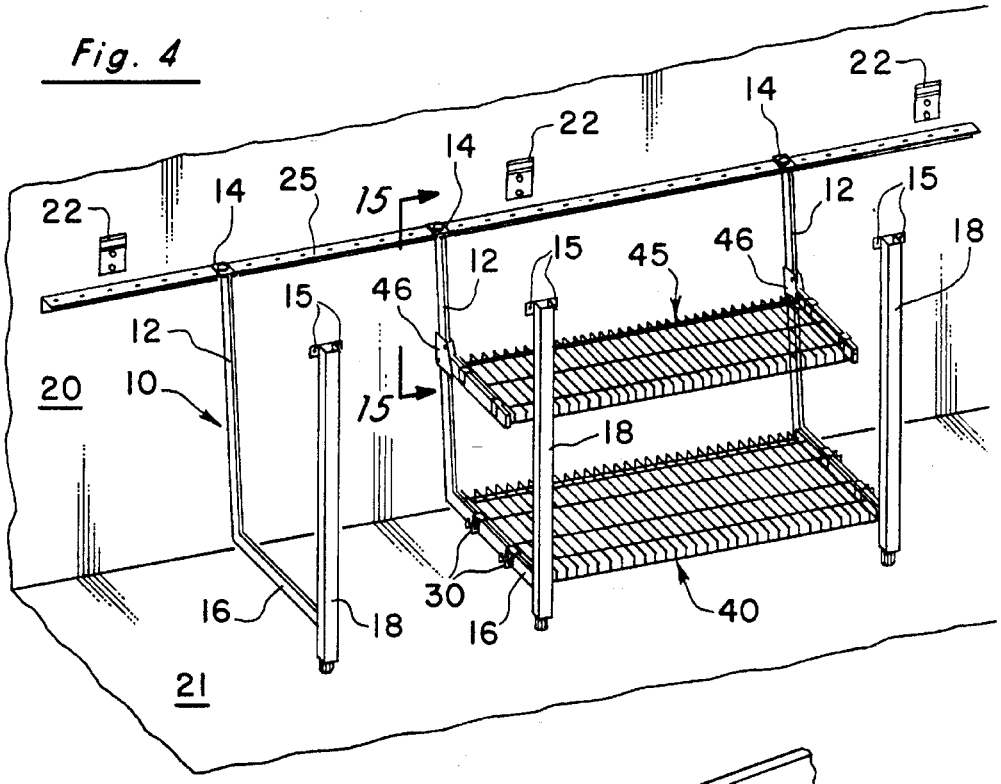
FIG. 4 is a front perspective view corresponding to FIG. 3 after a third leg assembly and several shelves have been attached.
Figure 5:
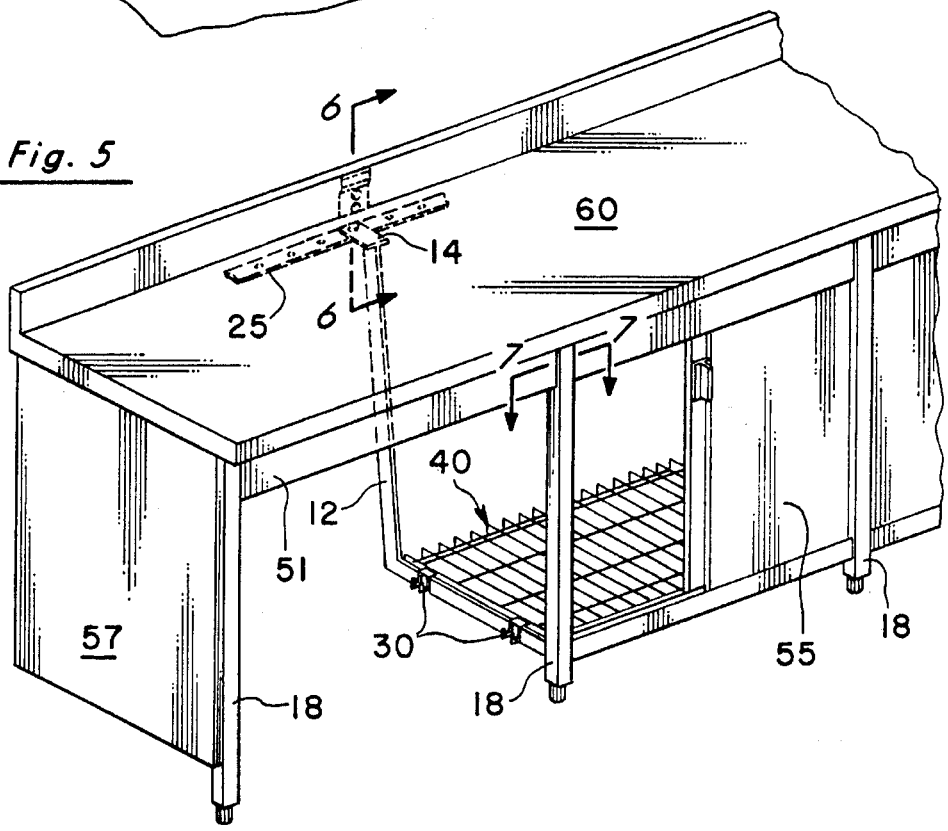
FIG. 5 is a front perspective view corresponding to FIG. 4 after the counter top and front panels have been attached.
Figures 9A, 9B:
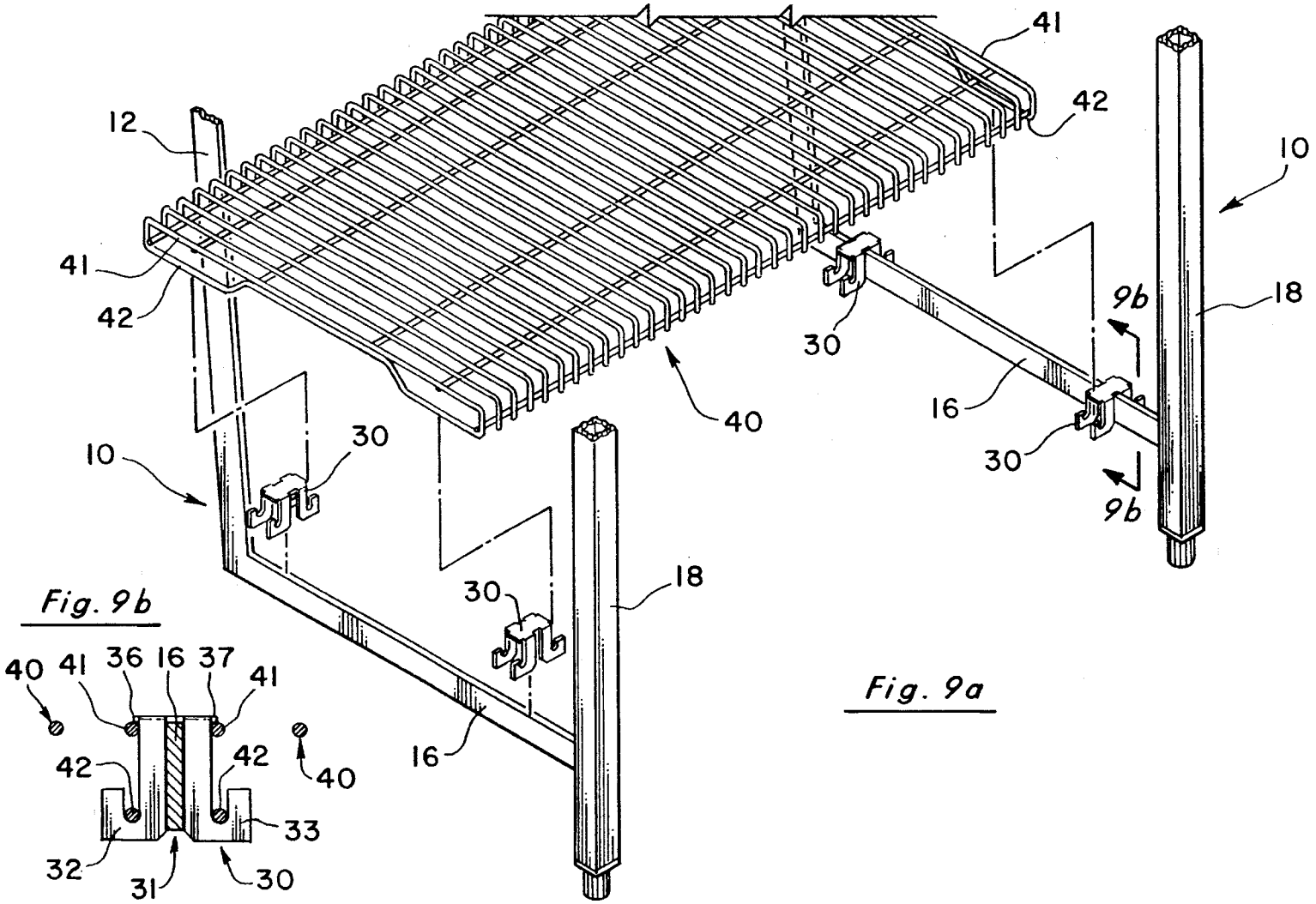
FIG. 9*a* is an exploded perspective view of a wire shelf secured between two leg assemblies.
FIG. 9*b* is a detail cross-sectional view of a clip showing the manner in which the lateral edges of two shelves are secured to the clip.
Figure 10:
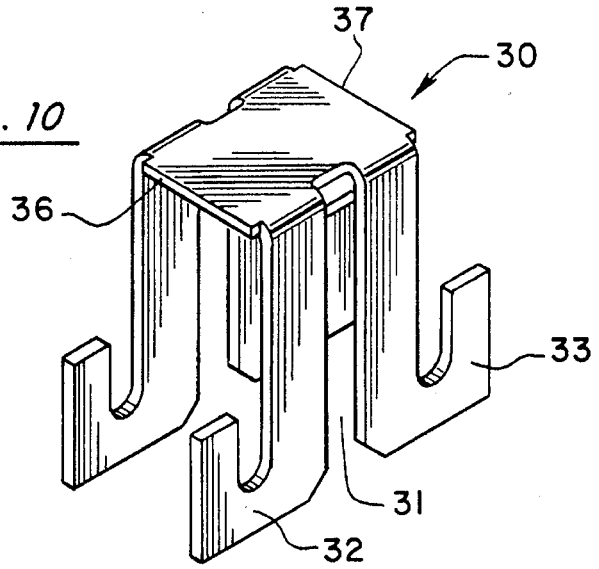
FIG. 10 is a perspective view of a clip used to secure two shelves to a leg assembly.
Figure 11A:
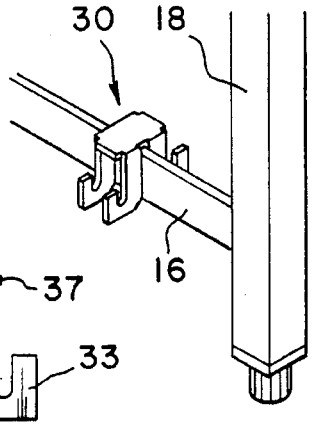
FIG. 11*a* is a fragmentary perspective view showing the clip from FIG. 10 attached to the horizontal member of a leg assembly.
Figure 11B:
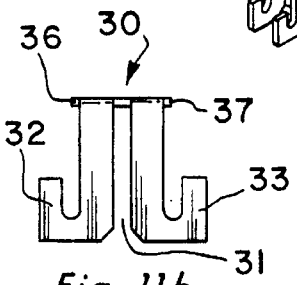
FIG. 11*b* is a front view of the clip shown in FIGS. 10 and 11*a*.

Wire shelves 40 are secured between adjacent leg assemblies as shown in FIG. 4 to further fix the dimensional accuracy of the fixture. Each wire shelf 40 is made of a plurality of parallel wire rods as shown most clearly in FIG. 9*a*. The shelf 40 has opposing lateral edges with an upper wire rod 41 and a lower wire rod 42 extending along each lateral edge.

A number of clips 30 are employed to removably secure each shelf 40 between adjacent leg assemblies 10, as illustrated in FIGS.

9*a*, 9*b*, 10, 11*a*, and 11*b*. The clip 30 has a substantially vertical slot 31 that receives the horizontal member 16 of one of the leg assemblies 10. At least one J-shaped member 32, 33 extends laterally outward from the vertical slot 31 to receive and support the lower wire rod 42 along one lateral edge of a shelf 40. A corresponding tab 36, 37 retains the upper wire rod 41 when the shelf 40 is engaged to the clip 30. This tab prevents the clip from accidentally releasing the shelf during normal use of the food service fixture, but allows the shelf to be readily disassembled and reassembled, if necessary. In addition, the clip 30 offers sufficient strength and rigidity to ensure that the assembled fixture is sturdy and dimensionally accurate. This arrangement also simplifies cleaning because the wire shelves 40 can be easily removed for washing and the underlying floor is readily accessible for mopping.

Figure 12A:
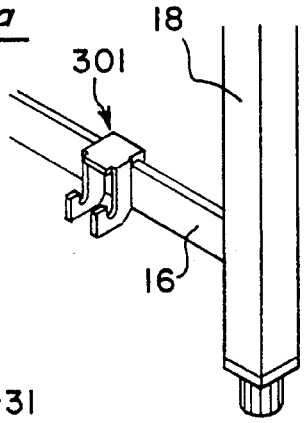
FIG. 12*a* is a fragmentary perspective view of an alternative embodiment of the clip intended to secure only one shelf to a leg assembly.
Figure 12B:
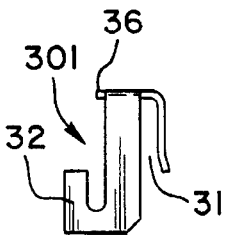
FIG. 12*b* is a front view of the clip shown in FIG. 12*a*.
Figure 13A:
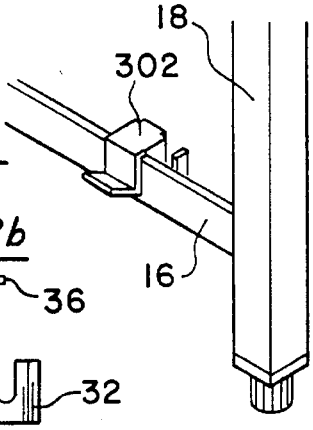
FIG. 13*a* is a fragmentary perspective view of yet another alternative embodiment of the clip.
Figure 13B:
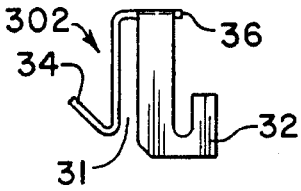
FIG. 13*b* is a front view of the clip shown in FIG. 13*a*.
Figure 14A:
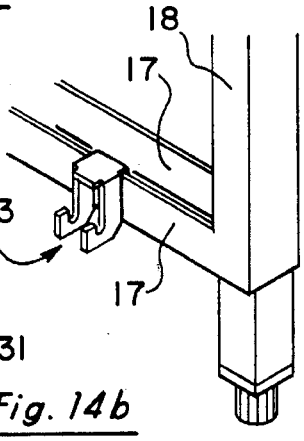
FIG. 14*a* is a fragmentary perspective view of yet another alternative embodiment of the clip.
Figure 14B:
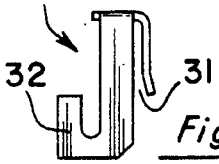
FIG. 14*b* is a front view of the clip shown in FIG. 14*a*.

The clips 30 shown in FIGS. 9*a*, 9*b*, 10, 11*a*, and 11*b* have two opposing J-shaped members 32 and 33 to allow each clip to engage two shelves 40 to a leg assembly 10. It should be expressly understood that the clip 30 could be designed in numerous alternative embodiments. For example, FIGS. 12*a* and 12*b* show an alternative embodiment of a clip 301 used to engage a single shelf. FIGS. 13*a* and 13*b* show another alternative embodiment of a clip 302 used to engage a single shelf and also support an end panel 57 of the type shown in FIG. 5. A finger 34 engages the bottom edge of the end panel 57 to provide structural support. FIGS. 14*a* and 14*b* show yet another alternative embodiment of a clip 303 for use in conjunction with a leg assembly having two parallel horizontal members 17. Separate clips 303 can be attached to each horizontal member 17 on either side of the leg assembly for greater flexibility in the placement and number of clips needed to support each shelf.

Figure 6:
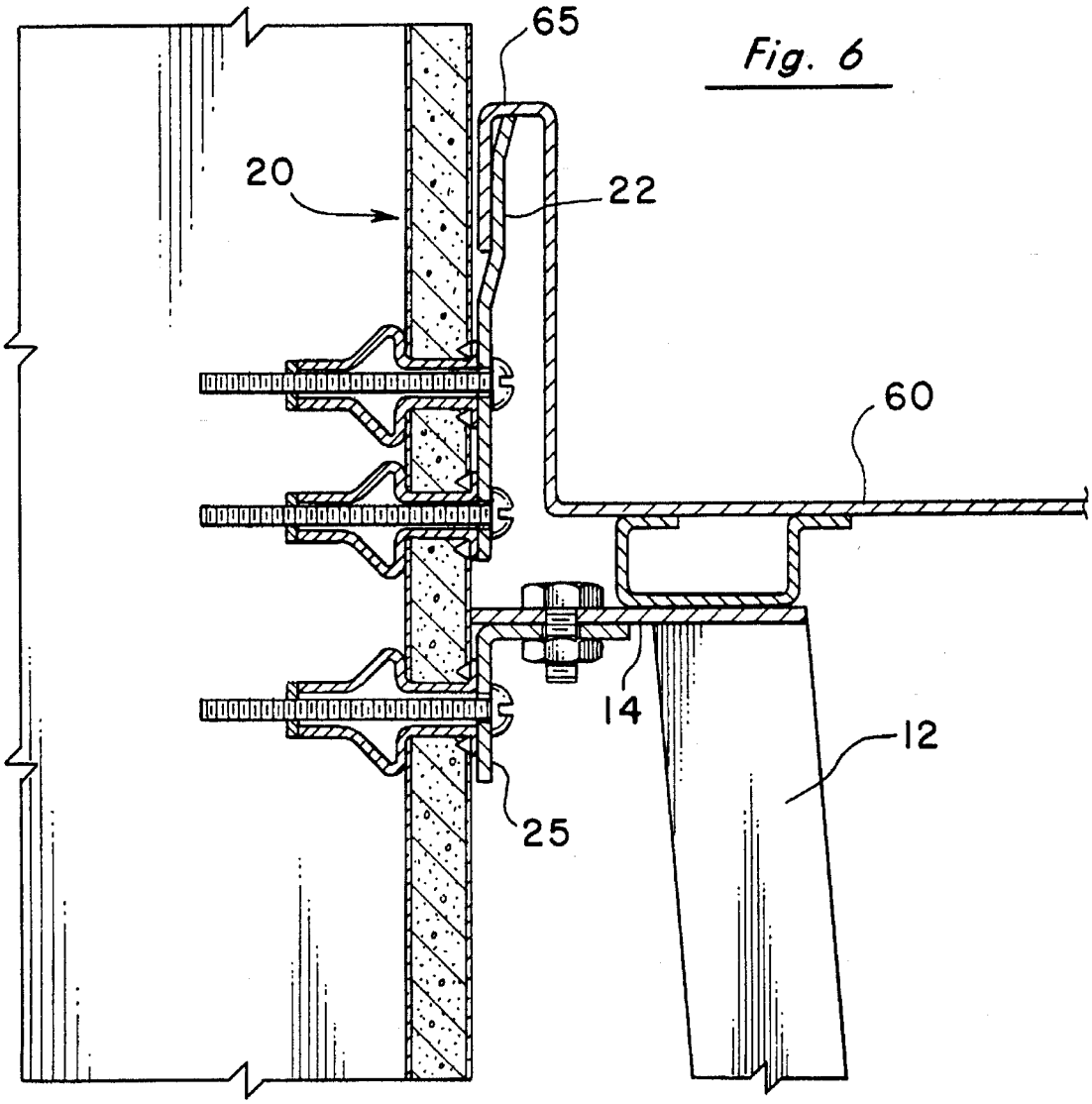
FIG. 6 is a detail cross-sectional view showing the manner in which the rail and counter top bracket are used to secure the counter top and the rear member of the leg assembly.
Figure 8:
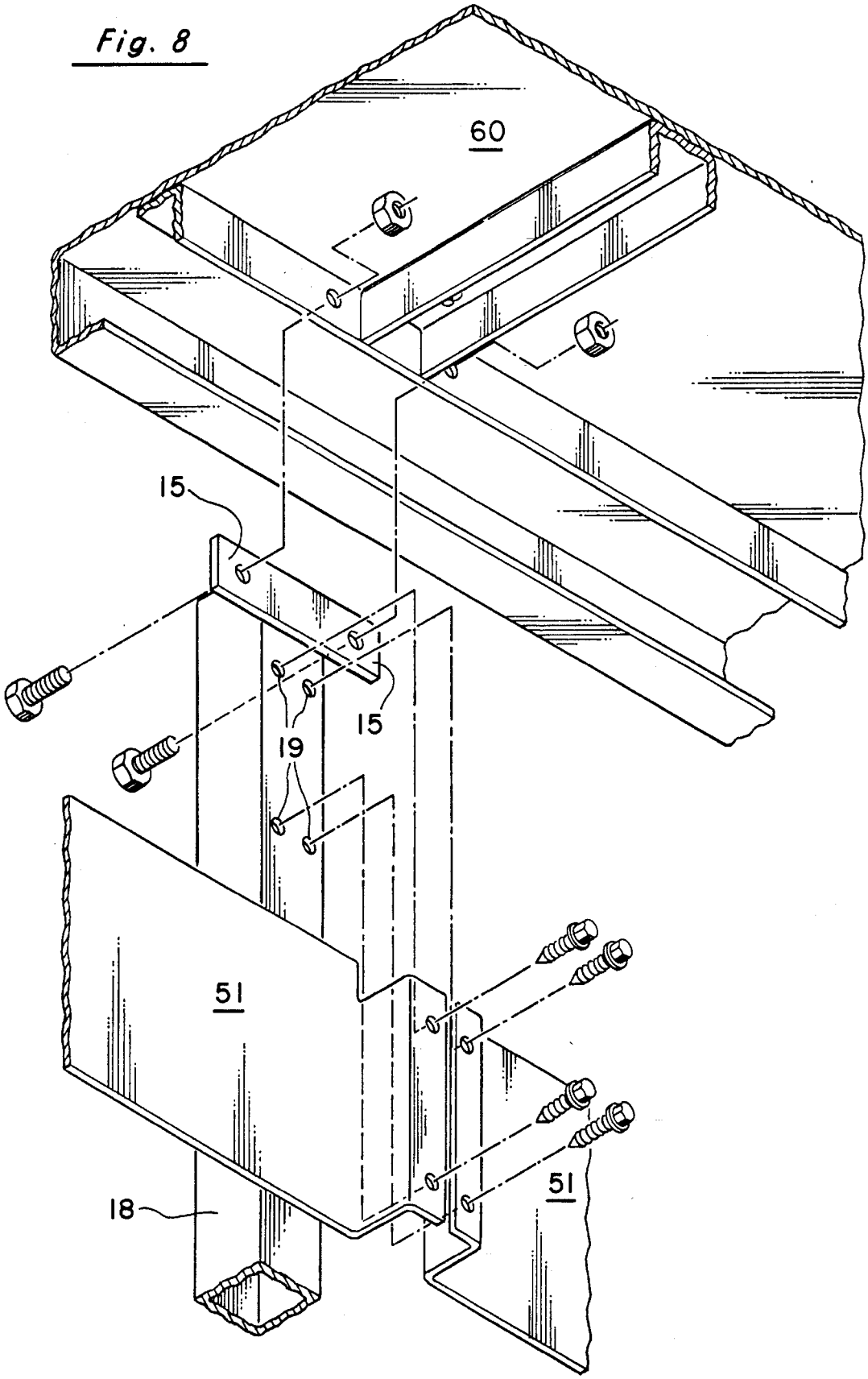
FIG. 8 is an exploded perspective view of portions of the underside of the counter top, the back of the front leg, and the rear surfaces of two front panels.

A counter top 60 is secured to the top of the food service fixture. The rear flange 65 of the counter top 60 engages the brackets 22 attached to the wall 20 as shown in FIG. 6. The counter top surface extends forward from the back plane of the fixture with its front edge supported by the upper ends of the front legs 18 of the leg assemblies 10. FIG. 8 shows an exploded detail view of the manner in which the front edge of the counter top 60 is secured with nuts and bolts to the brackets 15 on the front legs 18. The counter top can be a continuous surface or a series of discrete segments. In addition, the counter top can accommodate openings for warmers or fryers 61, disposals 62, sinks 63, stoves, or other appliances as shown in FIG. 1*b*.

Figure 7:
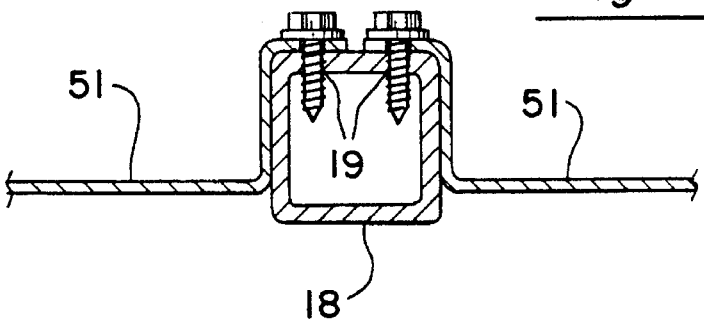
FIG. 7 is a detail cross-sectional view of the front leg of a leg assembly with two front panels attached.

Any of a wide variety of front members can be interchangeably fastened between the front legs of adjacent leg assemblies. For example, FIG. 1 a shows a plain panel 51 and a plate shelf 52. FIG. 1*b* shows a bun warmer 53, a control panel 54, and hinged or sliding doors 55. FIG. 8 is an exploded view illustrating how the front members 51 are fastened to the upper end of a front leg 18 using a standardized set of holes 19. A corresponding cross-sectional view of the front members 51 and the front leg 18 is provided in FIG. 7. The uniform location and arrangement of the holes 19 on the front legs 18 and each type of front member 51 makes the front members completely interchangeable to meet the customer's needs.

FIGS. 1*a* and 4 also show a second shelf 45 mounted above the lower shelf 40. Additional details are provided in FIGS. 15 and 16. The second shelf 45 is secured between the rear members 12 of two adjacent leg assemblies 10 by means of shelf brackets 46. In the preferred embodiment, these shelf brackets are formed in two halves that are secured around the rear member 12 of the leg assembly by means of bolts and nuts. However, other equivalent fastening means could be readily substituted, such as welding, crimping, rivets, etc.

One of the primary advantages of the present system is its modularity. This makes it very easy to customize and reconfigure food service fixtures. The present system also uses standardized lengths for shelves, front panels, and counter tops to reduce inventory and simplify assembly. Additionally, all leg assemblies have a uniform width. The dimensions of the various components that go into making each section in a fixture are sized so that the width of the assembled section is a convenient standard size (e.g., 36 inches, 42 inches, 48 inches, etc.).

The preceding discussion has assumed that the food service fixture is mounted to a wall 20 as its back plane. It should be expressly understood that a wall is not necessary. For example, the back rail could be attached to other equipment that serves as a back plane for the fixture. Alternatively, two fixtures can be attached back to back to make an island, although a support frame between the fixtures may be necessary to adequately support the back portions of both fixtures.

The above disclosure sets forth a number of embodiments of the present invention. Other arrangements or embodiments, not precisely set forth, could be practiced under the teachings of the present invention and as set forth in the following claims.

I claim:

1. A modular system for assembling food fixtures comprising:

a rail extending horizontally along a predetermined back plane;

a plurality of leg assemblies, each having:

(a) a rear member;

(b) means for selectively attaching said rear member to said rail at a desired location along said rail;

(c) a front leg having an upper end; and (d) a substantially horizontal member extending between said rear member and said front leg;

at least one wire shelf having opposing lateral edges with an upper wire rod and a lower wire rod extending along each of said lateral edges;

a plurality of clips for removably attaching said lateral edges of said shelf to said horizontal members of adjacent leg assemblies, thereby removably securing said shelf between adjacent leg assemblies, each clip having;

(a) a slot for receiving said horizontal member;

(b) a J-shaped member for receiving and supporting said lower rod; and (c) a tab for retaining said upper wire rod when said shelf is engaged to said clip; and a counter top extending from said back plane supported by said upper ends of said front legs.

2. The moudular system of claim 1, wherein said shelf is comprised of a plurality of substantially parallel wire rods.

3. The moudular system of claim 1, wherein said clip comprises a substantially vertical slot for receiving said horizontal member and laterally projecting members for removably engaging said lateral edge of at least one of said shelves.

4. The modular system of claim 1, wherein said front leg further comprises a standardized set of fastening means for interchangeably fastening any of a plurality of alternative front members between adjacent leg assemblies.

5. The modular system of claim 4, wherein said front member comprises a door.

6. The modular system of claim 4, wherein said front member comprises an apron.

7. The modular system of claim 4, wherein said front member comprises a plate shelf.

8. A modular system for assembling food service fixtures comprising:

a plurality of leg assemblies, each having:

(a) a rear member;

(b) a substantially vertical front leg having an upper end;

(c) a standardized set of fastening means associated with said front leg; and (d) a substantially horizontal member extending between said rear member and said front leg;

at least one wire shelf having opposing lateral edges with an upper wire rod and a lower wire rod extending along each of said lateral edges;

at least one wire shelf having opposing lateral edges with an upper wire rod and a lower wire rod extending along each of said lateral edges;

a plurality of clips for removably securing said shelf between adjacent leg assemblies, each clip having:

(a) a slot for receiving said horizontal member of one of said leg assemblies;

(b) a J-shaped member for receiving and supporting said lower wire rod; and (c) a tab for retaining said upper wire rod when said shelf is engaged to said clip;

a counter top supported by said upper ends of said front legs; and at least one front member extending between said fastening means on said front legs of adjacent leg assemblies.

9. The modular system of claim 8, further comprising a rail extending horizontally along a predetermined back plane, and means for selectively attaching said rear members of said leg assemblies to said rail at a desired locations along said rail.

10. The modular system of claim 8, wherein said shelf is comprised of a plurality of substantially parallel wire rods.

11. The modular system of claim 8, wherein said front member comprises a door.

12. The modular system of claim 8, wherein said front member comprises an apron.

13. The modular system of claim 8, wherein said front member comprises a plate shelf.

14. A modular system for assembling food service fixtures comprising:

a rail extending horizontally along a predetermined back plane;

a plurality of leg assemblies, each having:

(a) a rear member;

(b) means for selectively attaching said rear member to said rail at a desired location along said rail;

(c) a substantially vertical front leg having an upper end;

(d) a standardized set of fastening means associated with said front leg; and (e) a substantially horizontal member extending between said rear member and said front leg;

at least one wire shelf having opposing lateral edges with an upper wire rod and a lower wire rod extending along each of said lateral edges;

a plurality of clips for removably securing said shelf between adjacent leg assemblies, each clip having:

(a) a slot for receiving said horizontal member of one of said leg assemblies;

(b) a J-shaped member for receiving and supporting said lower wire rod; and (c) a tab for retaining said upper wire rod when said shelf is engaged to said clip;

a counter top extending from said back plane and supported by said upper ends of said front legs; and at least one front member extending between said fastening means on said front legs of adjacent leg assemblies.

15. The modular system of claim 14, wherein said shelf is comprised of a plurality of substantially parallel wire rods.

* * * * *